United States Patent [19]

Anderson

[11] Patent Number: 4,762,161

[45] Date of Patent: Aug. 9, 1988

[54] LOCKING DEVICE FOR USE WITH A BLIND ASSEMBLY

[75] Inventor: Richard N. Anderson, Owensboro, Ky.

[73] Assignee: Hunter Douglas Inc., Upper Saddle River, N.J.

[21] Appl. No.: 4,928

[22] Filed: Jan. 20, 1987

Related U.S. Application Data

[63] Continuation of Ser. No. 733,553, May 13, 1985, abandoned.

[51] Int. Cl.[4] ..... E06B 9/324

[52] U.S. Cl. ..... 160/178.2; 160/168.1

[58] Field of Search ..... 160/178 R, 178 B, 178 C, 160/107, 166 R, 168 R, 167, 169, 173

[56] References Cited

U.S. PATENT DOCUMENTS

| | | | |
|---|---|---|---|
| 2,298,892 | 10/1942 | Lorentzen | 160/178 R |
| 2,421,505 | 6/1947 | Hunter | 160/178 R X |
| 2,428,170 | 9/1947 | McDonald | 160/178 R |
| 2,662,261 | 12/1953 | Mikoski | 160/178 R |
| 2,896,893 | 7/1959 | Oliver | 160/178 R X |
| 2,901,035 | 8/1959 | Anderle | 160/178 R |
| 2,925,861 | 2/1960 | Long | 160/178 R |
| 3,153,819 | 10/1964 | Bond | 160/107 X |
| 3,447,586 | 6/1969 | Anderle | 160/178 R |
| 3,996,988 | 12/1976 | deWit | 160/168 R |
| 4,088,173 | 5/1978 | Antich | 160/178 R X |
| 4,224,974 | 9/1980 | Anderson et al. | 160/178 R |
| 4,425,955 | 1/1984 | Kaucic | 160/168 R |

*Primary Examiner*—Ramon O. Ramirez
*Assistant Examiner*—David M. Purol
*Attorney, Agent, or Firm*—Pennie & Edmonds

[57] ABSTRACT

A locking device for use with a blind assembly where the blind assembly has a fixed end rail and a movable end rail with a blind extending between the end rails. The locking device has a base portion adapted to be connected to a side member of a wall opening and the device is adapted when in a locking position to engage a portion of the movable end rail to prevent the movable end rail moving towards the fixed end rail and thus towards a blind open position.

4 Claims, 3 Drawing Sheets

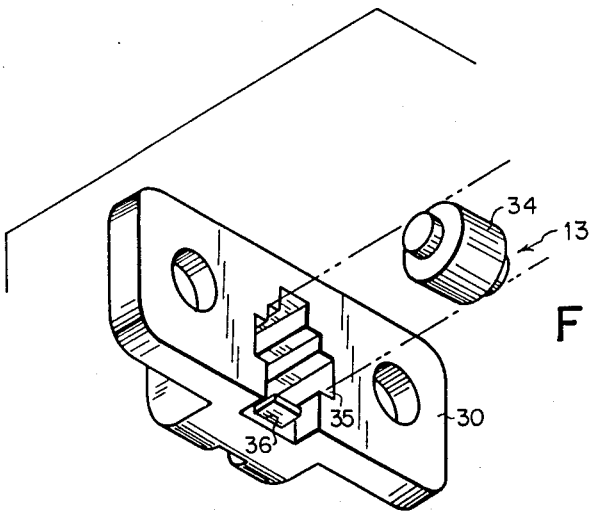
FIG. 4
FIG. 5
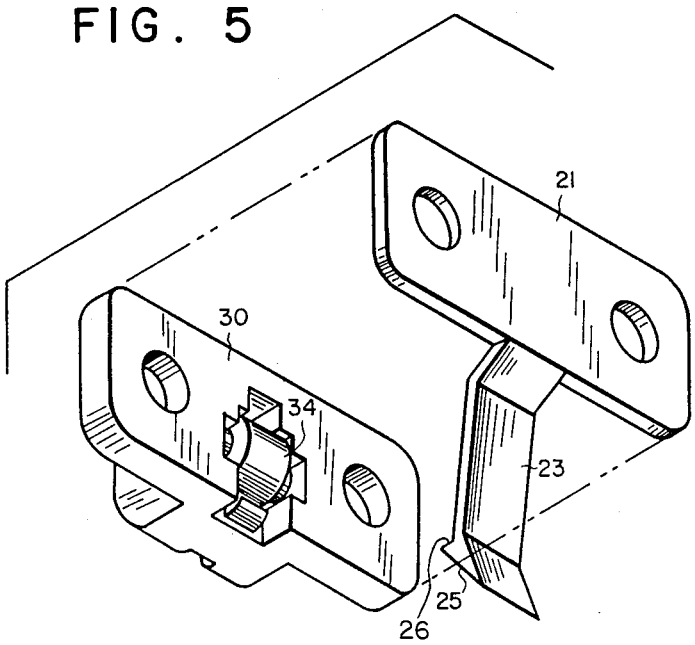

LOCKING DEVICE FOR USE WITH A BLIND ASSEMBLY

This is a continuation of application Ser. No. 733,553 filed May 13, 1985 now abandoned.

FIELD OF THE INVENTION

This invention relates to a locking device for use with a blind assembly to prevent inadvertent movement of the blind assembly from a closed position to an open position. More particularly the invention relates to a locking device adapted for use with a blind assembly comprising a fixed end rail, a movable end rail and a blind extending between the two end rails where the blind is moved towards open and closed positions by movement of the movable end rail.

BACKGROUND OF THE INVENTION

Blind assemblies as used with boats or recreational vehicles subject to vibration and movement often include a cable guide system extending between opposite sides of a wall opening, for example a window opening or a porthole opening, where the cable guide system contains and guides a movable end rail and where the blind extends between the movable end rail and an end rail fixed to a side of the wall opening. The blind in such instances may comprise a plurality of slats or a pleated fabric-like material and the blind is opened by movement of the movable end rail towards a fixed end rail and is closed by movement of its movable end rail away from the fixed end rail.

Normally in such installations the cable guide system connecting the movable end rail assures that the movable end rail will remain in place after manual movement to a particular position by an operator. However, in many instances, particularly where the blind assembly is subject to vibration or excessive movement as may occur in a boat or a recretional vehicle, the movable end rail may be inadvertently moved towards a blind open position.

It is therefore an object of my invention to provide for a locking device which will prevent inadvertent movement of a blind assembly towards an open position where the blind assembly comprises a fixed end rail, a movable end rail and a blind extending between the end rails.

GENERAL DESCRIPTION OF THE INVENTION

Broadly a locking device according to my invention is adapted for use with a blind assembly which is mounted in a wall opening and which comprises a fixed end rail, a movable end rail and a blind extending between the two end rails where the blind is moved towards open and closed positions by movement of the movable end rail. The locking device includes a base portion which is adapted to be connected to a side of the wall opening so as to engage a part of a movable end rail to prevent its movement towards a blind open position.

Preferably the locking device includes a resilient finger portion which is connected at one end to the base portion and is adapted to engage at its free end with a part of the movable end rail when in a locking position. The resilient finger further is adapted to be moved out of engagement with the movable end rail to an unlocked position to allow movement of the end rail towards the fixed end rail and consequently opening of the blind.

The free end of the resilient finger may include a beveled surface ending in a locking shoulder with the surface adapted to engage a projection on the end of the movable end rail such that when the movable end rail is moved towards a blind closed position, the projection will slide along the beveled surface to force the finger portion towards an unlocked position. When the projection slides beyond the end of the beveled surface, the finger portion will snap to a locking position where its locking shoulder engages a side of the projection on the movable end rail.

The base portion to which the resilient finger is connected and which is adapted to be affixed to a side of a wall opening is preferably engaged by a cap member for fixing the base member to the side of the wall opening. This cap member may conveniently include an operating cable turning means by which an operating cable, which acts as a means for moving the movable end rail, may be guided through substantially 180°. In a preferred form of the invention, this turning means comprises a roller rotatably mounted within the cap member.

The portion of the end rail which is contacted by the free end of the resilient finger may conveniently comprise an end cap mounted on the end of the movable end rail and which has thereon a cable connection means by which an operating cable is secured to the movable end rail and where the free end of the finger portion engages this operating cable connection means.

The locking device comprising the base portion and the finger portion as well as the cap member may be conveniently cast from a plastic material whereby construction costs are minimized.

BRIEF DESCRIPTION OF THE DRAWINGS

FIG. 4 is a perspective view of a cap member utilized for securing the locking device of FIGS. 1–3 to the side of a wall opening; and, FIG. 5 is an exploded perspective view illustrating the manner in which the locking device according to the invention is mounted to the cap member of FIG. 4.

DESCRIPTION OF THE PREFERRED EMBODIMENT

Figure 1:
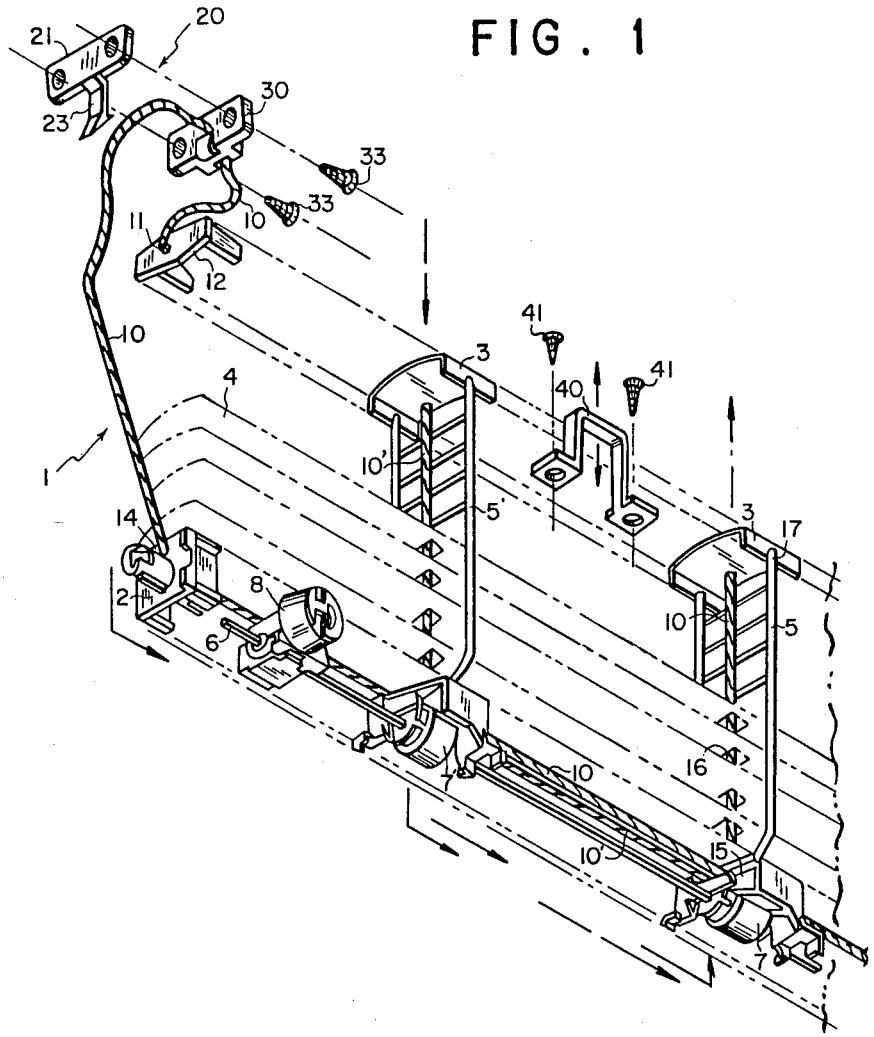
FIG. 1 is an exploded perspective view of a locking device according to the invention as used with a blind construction.

Referring to FIG. 1 there is illustrated a blind assembly 1 having a fixed lower end rail 2 and an upper movable end rail 3 adapted to be mounted in a wall opening, not shown. A plurality of slats 4 are carried between the fixed end rail 2 and the movable end rail 3 by means of tape adders 5 and 5'.

The bottom fixed end rail 2 includes a conventional tilt rod 6 on which are mounted tilt rolls 7 and 7' which connect with the tape ladders 5 and 5' such that when the rod 6 is rotated by means of tilt control knob 8 the slats may be tilted to open and closed positions.

In the blind assembly shown, an operating cord 10 is connected at one end with the movable end rail 3 by means of a cable connection means 11 contained in an end cap 12 fitted into the end of the movable end rail 3. Cable 10 extends from the cable connection means 11 through a cable turning means 13 which is fixed relative to the side of a window opening. The cable 10 then extends vertically downwardly to the fixed end rail 2 where it is turned 90° through the end 14 of the fixed end rail. From the end 14 of the fixed end rail, the cable extends within the end rail to a further turning point 15 where the cable is turned 90° and extends upwardly through holes 16 contained in the slats to connect with the end slat 3 at point 17.

A further operating cable 10' is included in the system and extends through the fixed end rail in the same manner as cable 10 but connects with the opposite end of the movable end rail, not shown.

The result of this particular cable guide system is that the blind assembly will tend to remain in place no matter which position the end rail is manually moved. This is because the cable 10 extending between the end of the end rail 3 and the turning point 13 will shorten as the end rail is moved upwardly while the portion of the cable between the end rail 3 and point 15 in the fixed end rail will lengthen an equal amount with the result that the tension in both ends of the cable 10 is the same. However, in some instances, the end rail will not remain in place, and particulaly when the end rail is in blind closed position, that is when it is at the top of its movement away from the fixed end rail, the end rail can inadvertently move downwardly to open the blind assembly. This may occur when the blind assembly is subjected to severe vibration or pounding as may occur in a recreational vehicle over a rough road or in a boat in rough seas.

Figure 2:
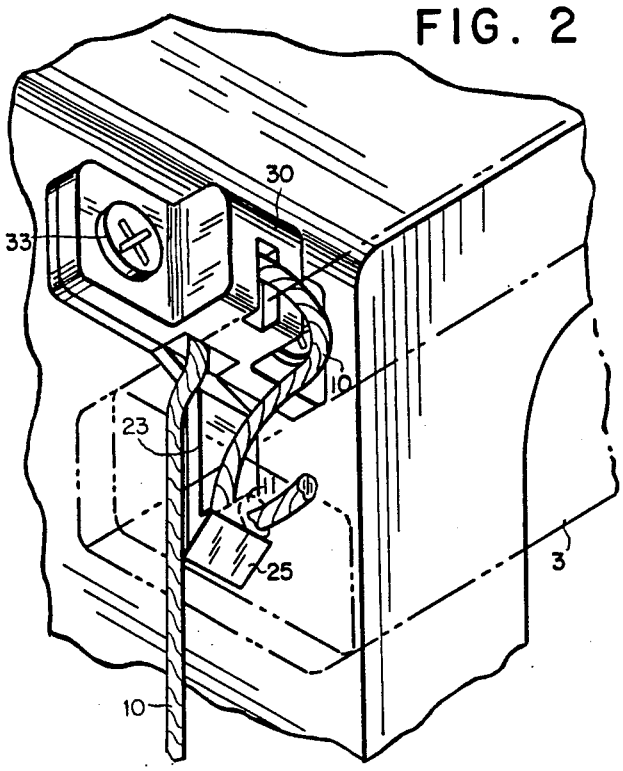
FIG. 2 is an enlarged perspective view of a locking device according to the invention in locking engagement with an end of a movable end rail.
Figure 3:
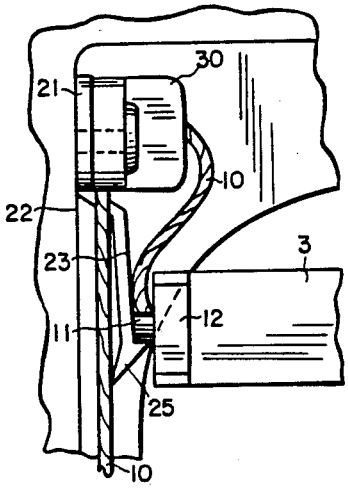
FIG. 3 is a front view of the locking device of FIG. 2 shown in locking engagement with a movable end rail.

In order to prevent this inadvertent opening of the blind assembly, a locking device 20 is provided so as to engage and lock the movable end rail against inadvertent movement when the end rail is in a blind closed position. Referring to the figures, the locking device 20 comprises a base portion 21 which as shown in FIG. 3 is adapted to be fixed against a side 22 of a wall opening. The locking device includes a resilient finger portion 23 which is fixed at one end to the base portion 21 and which has a free end 24 at its other end. End 24 includes a beveled surface 25 and a locking shoulder 26. As shown in FIG. 3, the locking shoulder 26 engages a side of the cable connecting means 11 of the end cap 12 mounted on the end rail 3. As shown in FIG. 2 the cable 10 is threaded through a hole in the cable connection means 11 by which the cable is connected to the movable end rail.

When the end rail 3 is moved in an upward direction, the cable connection means 11 engages the beveled surface 25 and slides along the length thereof to force the resilient finger portion 23 outwardly of the end rail until such time as the end of the cable connection means 11 slides beyond the locking shoulder 26. At this point the resilient finger 23 will snap towards the end of the end rail to a locking position where the locking shoulder 26 engages the bottom of the cable means 11 to securely lock the end rail from downward movement towards the fixed end rail 2 and thus securely locking the blind assembly from movement to an open position.

When it is desired to open the blind manual means may be used to move the resilient finger 23 away from the end of the movable end rail 3 to allow the cable connection means 11 to disengage from the locking shoulder 26 and the movable end rail to move the end towards the fixed end rail.

The locking device comprising the resilient finger portion 23 and base portion 21 are secured to the side 22 of the wall opening by means of a cap member 30 which contains the operating cable turning means 13. Both the cap member 30 and the base portion 21 are adapted to be held to the side wall 22 by means of screws 33.

As shown in FIG. 4, the turning means 13 comprises a roller 34 which fits into recess 35 contained in the cap member. The cable 10 passes over the roller 34 and downwardly between the cap portion 30 and base portion 21 to the fixed end rail. By this construction, the locking device may be combined with the cable turning means to present a small combined structure both of which may be secured to the side of a wall opening by the same fastening means 33.

The movable end rail 3 is provided with a handle 40 connected to the end rail by screws 41 in order to impart movement to the end rail so as to open and close the blind assembly.

While I have described and shown the movable end rail positioned above the fixed end rail so that the blind assembly is closed by raising the movable end rail, it is apparent that the structure could be reversed 180°. That is, the fixed end rail 2 could be positioned above the movable end rail so that the blind would be closed by lowering the movable end rail toward the bottom of the wall opening.

I claim:

1. A blind assembly including a locking device, said blind assembly mounted in a wall opening and comprises a fixed end rail, a movable end rail, a blind extending between the end rails, and means for moving said movable end rail relative to said fixed end rail to move said blind towards open and closed positions; said locking device including a base portion adapted to be connected to a side member of said wall opening, a resilient finger portion connected at one end to said base portion and adapted at its opposite free end to engage with a part of said movable end rail when in a locking position and to be moved out of engagement with said part when moved to an unlocked position, the free end of said resilient finger portion includes a beveled surface ending in a locking shoulder adapted to engage a projection on an end of said movable end rail when said movable end rail is in a blind closed position whereby when said movable end rail is moved towards a blind closed position, said projection will slide along said surface to move said finger portion towards an unlocked position until said projection moves beyond the end of said surface at which point the finger portion will snap to a locked position with the locking shoulder engaging a side of said projection thereby preventing movement of said movable end rail to a blind open position, said means for moving said movable end rail including an operating cable for moving said movable end rail and a cap member adapted to connect said base portion to a side member and wherein said cap member includes operating cable turning means by which said operating cable is guided through substantially 180°.

2. A blind assembly according to claim 1 wherein said cable turning means comprises a roller rotatably mounted within said cap member.

3. A blind assembly according to claim 1 wherein said free end is adapted to engage an operating cable connection means contained on an end cap mounted on an end of said movable end rail and forming said part of said end rail.

4. A blind assembly including a locking device, said blind assembly mounted in a wall opening and comprises a fixed end rail, a movable end rail, a blind extending between the end rails, the means including an operating cable for moving said movable end rail relative to said fixed end rail to move said bind towards opened and closed positions; said locking device including a base planar portion adapted to be connected to a side member of said wall opening, a depending flange defined by a resilient finger portion connected at one end to said planar base portion and adapted at its opposite free end to engage with a part of said movable end rail when in a locking position and to be moved out of engagement with said part when moved to an unlocked position, the free end of said resilient finger portion includes a beveled surface ending in a locking shoulder adapted to engage a projection on an end of said movable end rail when said movable end rail is in a blind closed position whereby when said movable end rail is moved towards a blind closed position, said projection will slide along said surface to move said finger portion towards an unlocked position until said projection moves beyond the end of said surface at which point the finger portion will snap to a locked position with the locking shoulder engaging a side of said projection thereby preventing movement of said movable end rail to a blind opened position; and a plate shaped cap member adapted to connect said base portion to a side member, said cap member including as recess containing operating cable turning means by which said operating cable is guided through substantially 180°.

* * * * *